US010543681B2

(12) United States Patent
Kawamoto

(10) Patent No.: US 10,543,681 B2
(45) Date of Patent: Jan. 28, 2020

(54) LIQUID JET HEAD AND LIQUID JET DEVICE

(71) Applicant: SII Printek Inc., Chiba-shi, Chiba (JP)

(72) Inventor: Shunji Kawamoto, Chiba (JP)

(73) Assignee: SII PRINTEK INC., Chiba-Shi, Chiba (JP)

( * ) Notice: Subject to any disclaimer, the term of this patent is extended or adjusted under 35 U.S.C. 154(b) by 0 days.

(21) Appl. No.: 16/043,722

(22) Filed: Jul. 24, 2018

(65) Prior Publication Data

US 2019/0030883 A1 Jan. 31, 2019

(30) Foreign Application Priority Data

Jul. 27, 2017 (JP) ..... 2017-145644

(51) Int. Cl.
*B41J 2/45* (2006.01)
*B41J 2/045* (2006.01)

(52) U.S. Cl.
CPC ..... *B41J 2/0451* (2013.01); *B41J 2/04586* (2013.01)

(58) Field of Classification Search
CPC ... B41J 2/0451; B41J 2/04541; B41J 2/04586
See application file for complete search history.

(56) References Cited

U.S. PATENT DOCUMENTS 7,321,444 B2 * 1/2008 Hirayama ..... B41J 2/04541 358/1.17
8,864,276 B2 * 10/2014 Yamato ..... B41J 2/04508 347/19
2011/0273507 A1 11/2011 Yamato et al.
2018/0272700 A1 * 9/2018 Ito ..... B41J 2/04508

FOREIGN PATENT DOCUMENTS

JP 2011-255670 12/2011

* cited by examiner

*Primary Examiner* — Sharon A. Polk
(74) *Attorney, Agent, or Firm* — Brinks Gilson & Lione

(57) ABSTRACT

An object of the invention is to provide a liquid jet head and a liquid jet device each capable of improving the print quality even in the case in which an error occurs in the print data. The liquid jet head includes a receiving section adapted to receive print data, a discriminant section adapted to discriminate whether or not the print data received is non-defective, and a control section adapted to hold the print data in a case in which the print data is non-defective, or perform printing based on the print data held currently without holding the print data received in a case in which the print data received is defective.

7 Claims, 12 Drawing Sheets

LIQUID JET HEAD AND LIQUID JET DEVICE

RELATED APPLICATIONS

This application claims priority under 35 U.S.C. § 119 to Japanese Patent Application No. 2017-145644 filed on Jul. 27, 2017, the entire content of which is hereby incorporated by reference.

BACKGROUND OF THE INVENTION

1. Field of the Invention

The present invention relates to a liquid jet head and a liquid jet device.

2. Background Art

In an inkjet recording device, information is printed on a recording medium by ejecting ink from a plurality of nozzles of a recording head in accordance with a recording signal. Such a recording device has, for example, a controller, a head driver, and a recording head including a plurality of nozzles. Further, in such a recording device, the controller transmits the recording signal to the head driver in the form of serial data or parallel data.

In the case in which the number of the recording heads increases, the number of wiring lines of the transmission line for transmitting the recording signal, and the number of connectors increase. As described above, if the transmission line increases in number or in length, the electric reliability of the recording signal deteriorates in some cases. In the case in which the electric reliability of the recording signal deteriorates, an error occurs in transmission of the recording signal, and the desired printing cannot be performed at the desired position in some cases.

Therefore, in the technology described in JP-A-2011-255670 (Document 1), a transmission error of the recording signal is detected in real time on the head driver side, then the result of the detection is transmitted to the controller, and then the controller performs the print control in accordance with the result of the detection.

However, in the technology described in Document 1, if the cable connecting the controller and the head driver side to each other is elongated, due to external noise, deterioration of the waveform, and so on, an error of the transmission data occurs, and thus, the deterioration of the print quality such as a void in printing occurs in some cases. Further, in the technology described in Document 1, it is necessary to transmit a response signal to the print data thus received to the controller side. In order to transmit the response signal to the controller side as described above, the connection between the liquid jet head side and the controller requires an upstream high-speed signal line for the response signal and a retry signal.

The invention is made in view of the problem described above, and has an object of providing a liquid jet head and a liquid jet device each capable of improving the print quality even in the case in which an error occurs in the print data.

SUMMARY OF THE INVENTION

In order to achieve the object described above, a liquid jet head according to an aspect of the invention includes a receiving section adapted to receive print data, a discriminant section adapted to discriminate whether or not the print data received is non-defective, and a control section adapted to hold the print data in a case in which the print data is non-defective, and perform printing based on the print data held currently without holding the print data received in a case in which the print data received is defective.

According to this configuration, the discrimination on whether or not the print data is non-defective is performed on the liquid jet head side, and in the case in which the print data is defective, printing is performed using the non-defective print data held currently. Therefore, it is possible to improve the print quality. Further, according to this configuration, the liquid jet head performs the discrimination on whether or not the print data is non-defective and the dealing process of the case in which the print data is defective by itself, and there is no need to transmit the response signal to the print data received to the controller side which has transmitted the print data. Thus, the upstream high-speed signal lines for the response signal and the retry signal become unnecessary for the connection between the liquid jet head side and the controller.

Further, in the liquid jet head according to an aspect of the invention, it is possible that the discriminant section performs an error check on each of a plurality of the print data transmitted between instruction signals adapted to instruct output, and the control section holds non-defective one of the print data in a case in which any one of the print data is non-defective, and does not hold the print data in a case in which all of the print data are defective.

According to this configuration, if any one of the plurality of the print data transmitted between the instruction signals is non-defective, the printing is performed based on the non-defective print data, or if all of the print data are defective, the printing is performed based on the print data currently held. Therefore, it is possible to improve the printing quality.

Further, in the liquid jet head according to an aspect of the invention, it is possible that in a case in which the control section has received the plurality of the print data between the instruction signal adapted to instruct the output and the instruction signal, the control section holds one received at earliest time of the plurality of non-defective print data received.

According to this configuration, even in the case in which a plurality of non-defective print data can be received between the instruction signals, by performing printing based on the non-defective print data which can firstly be received, it is possible to reduce the rewrite of the print data thus held. Thus, according to this configuration, since the process on the liquid jet head side can be reduced, it is possible to reduce the power consumption.

Further, in the liquid jet head according to an aspect of the invention, it is possible that the print data is attached with an error detection code.

According to this configuration, since the error detection code such as the CRC is attached to the print data, by checking the error detection code attached to the print data, it is possible to improve the error detection accuracy compared to the parity or the check sum using simple addition.

Further, in the liquid jet head according to an aspect of the invention, it is possible that the discriminant section counts a number of times of occurrence of a state in which the print data is defective so as to store the number to a storage section.

According to this configuration, it is possible for the controller to perform error processing such as increasing the number of the print data transmitted in a predetermined period in the case in which the number of errors is large by retrieving the number of errors stored in the liquid jet head. Further, according to this configuration, in the case in which the number of errors is no smaller than a predetermined threshold value, it is possible for the controller to abort the operation of the liquid jet head.

Further, in the liquid jet head according to an aspect of the invention, it is possible that the control section in a first stage of the plurality of control sections is provided with the discriminant section, and the discriminant section provided to the control section in the first stage performs the discrimination on whether or not the print data is non-defective, so as to output a result of the discrimination to the other control sections.

According to this configuration, there is no need for all of the plurality of control sections to respectively perform the discrimination on whether or not the print data is non-defective, and it is possible to improve the print quality with a simple configuration.

In order to achieve the object described above, a liquid jet device according to another aspect of the invention includes any one of the liquid jet heads describe above, and a controller adapted to transmit the print data to the liquid jet head.

According to this configuration, the discrimination on whether or not the print data is non-defective is performed on the liquid jet head side, and in the case in which the print data is defective, printing is performed using the non-defective print data held currently. Therefore, it is possible to improve the print quality. Further, according to this configuration, the liquid jet head performs the discrimination on whether or not the print data is non-defective and the dealing process of the case in which the print data is defective by itself, and there is no need to transmit the response signal to the print data received to the controller side which has transmitted the print data. Thus, the upstream high-speed signal lines for the response signal and the retry signal become unnecessary for the connection between the liquid jet head side and the controller.

According to invention, even in the case in which an error occurs in the print data, it is possible to improve the print quality without requiring the upstream high-speed signal lines for the response signal and the retry signal.

DETAILED DESCRIPTION OF THE INVENTION

Figure 1:
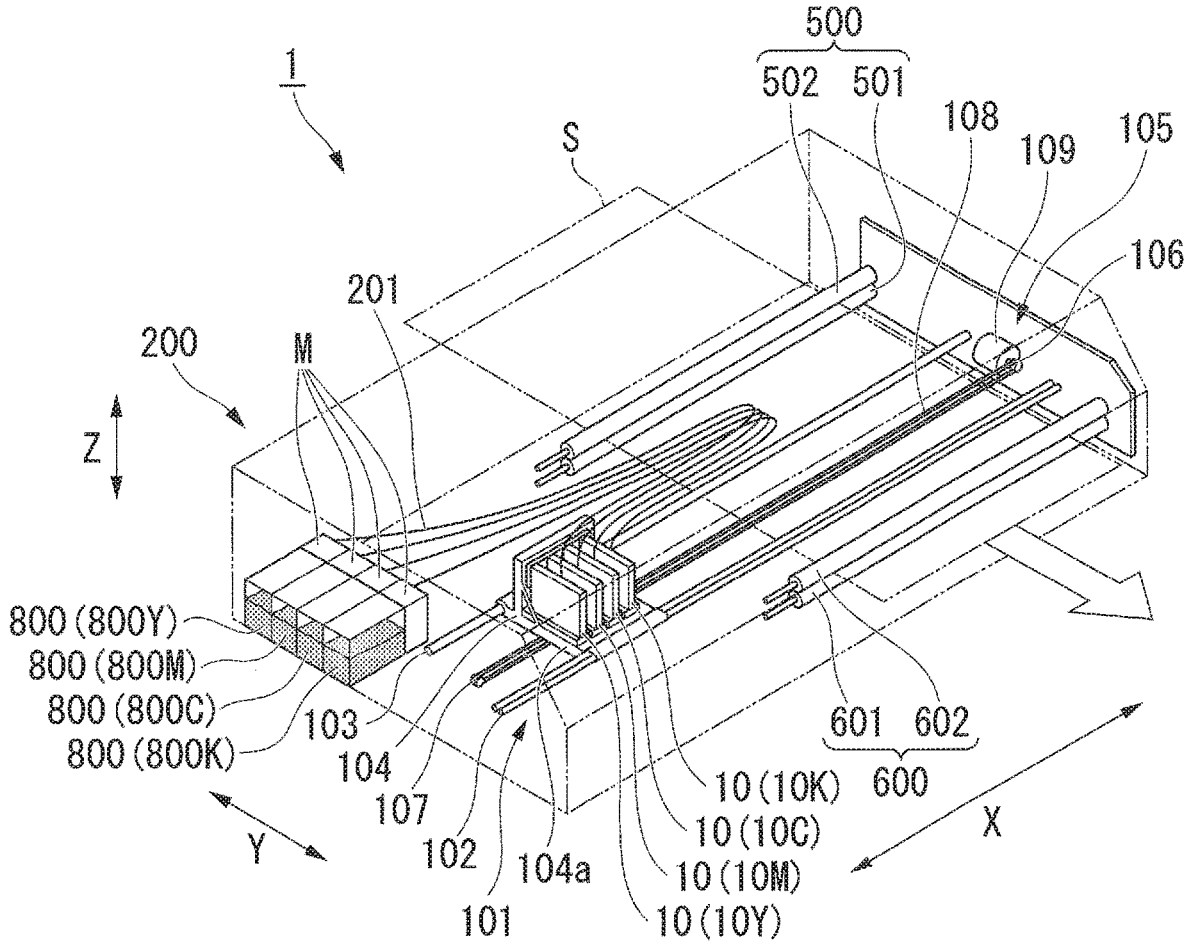
FIG. 1 is a perspective view of a liquid jet device according to a first embodiment of the invention.

Some embodiments of the invention will hereinafter be described with reference to the drawings. It should be noted that the scale size of each member is accordingly modified so as to provide a recognizable size to the member in the drawings used in the following description.

First Embodiment

FIG. 1 is a perspective view of a liquid jet device (printing device) 1 according to the present embodiment.

As shown in FIG. 1, the liquid jet device 1 is configured including a pair of conveying mechanisms 500, 600 for conveying a recording target medium S such as a paper sheet, liquid jet heads 10 for ejecting ink droplets to the recording target medium S, a liquid supply section 200 for supplying the liquid jet heads 10 with ink, and a scanning section 101 for making the liquid jet heads 10 perform a scanning operation in a direction (a sub-scanning direction) roughly perpendicular to a conveying direction (a main scanning direction) of the recording target medium S. It should be noted that the liquid jet device 1 is, for example, an inkjet printer.

It should be noted that, in the following description, the sub-scanning direction is defined as an X direction, the main scanning direction is defined as a Y direction, and a direction perpendicular to both of the X direction and the Y direction is defined as a Z direction. The liquid jet device 1 is installed so that the X direction and the Y direction are horizontal directions, and the Z direction is a vertical direction parallel to the gravitational direction, and is then used.

In other words, there is adopted a configuration in which the liquid jet heads 10 make the scanning movement on the recording target medium S along the horizontal directions (the X direction and the Y direction) in the state in which the liquid jet device 1 is installed. Further, there is adopted a configuration in which the ink droplet is ejected from the liquid jet head 10 downward along the gravitational direction (downward along the Z direction), and then lands on the recording target medium S.

The pair of conveying mechanisms 500, 600 are respectively provided with grit rollers 501, 601 disposed so as to extend in the X direction, pinch rollers 502, 602 extending in parallel respectively to the grit rollers 501, 601, and a drive mechanism such as a motor for making the grit rollers 501, 601 perform a rotational operation around the respective axes although not shown in detail.

The liquid supply section 200 is provided with liquid containers 800 in which the ink is housed, and liquid supply tubes 201 for respectively connecting the liquid containers 800 and the liquid jet heads 10 to each other. There is disposed a plurality of the liquid containers 800, and for example, ink tanks 800Y, 800M, 800C, and 800K respectively containing four types of ink of yellow, magenta, cyan, and black are arranged side by side. The ink tanks 800Y, 800M, 800C, and 800K are each provided with a pump motor M, which pressures the ink to move to the liquid jet head 10 through the liquid supply tube 201. The liquid supply tubes 201 are each formed of, for example, a flexible hose having flexibility capable of corresponding to the action of the liquid jet head 10 (a carriage unit 104).

It should be noted that the liquid containers 800 are not limited to the ink tanks 800Y, 800M, 800C, and 800K respectively containing the four types of ink of yellow, magenta, cyan, and black, but can also be provided with ink tanks containing a larger number of colors of ink.

The scanning section 101 is provided with a pair of guide rails 102, 103, the carriage unit 104, and a drive mechanism 105, wherein the pair of guide rails 102, 103 are disposed so as to extend in the X direction, the carriage unit 104 can slide along the pair of guide rails 102, 103, and the drive mechanism 105 moves the carriage unit 104 in the X direction. The drive mechanism 105 is provided with a pair of pulleys 106, 107 disposed between the pair of guide rails 102, 103, an endless belt 108 wound between the pair of pulleys 106, 107, and a drive motor 109 for rotationally driving the pulley 106 as one of the pulleys 106, 107.

One of the pair of pulleys 106, 107 is disposed between one end parts of the pair of guide rails 102, 103, and the other of the pair of pulleys 106, 107 is disposed between the other end parts of the pair of guide rails 102, 103, and thus, the pair of pulleys 106, 107 are disposed so as to be spaced from each other in the X direction. The endless belt 108 is disposed between the pair of guide rails 102, 103, and the carriage unit 104 is connected to the endless belt 108. On a base end part 104*a* of the carriage unit 104, there is mounted the plurality of liquid jet heads 10. Specifically, the liquid jet heads 10Y, 10M, 10C, and 10K individually corresponding to the four types of ink of yellow, magenta, cyan, and black are mounted side by side in the X direction.

(Liquid Jet Head)

Figure 2:
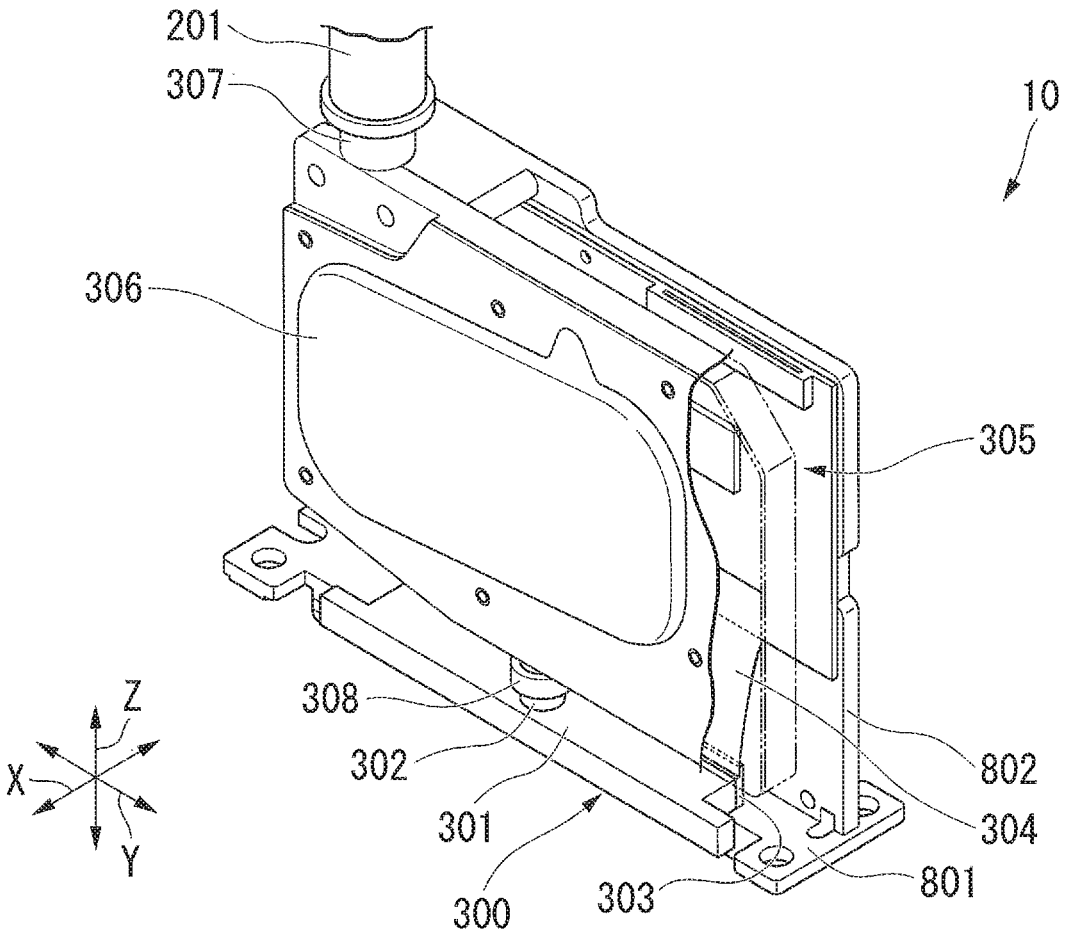
FIG. 2 is a partial cross-sectional view of a liquid jet head according to the first embodiment.

FIG. 2 is a partially broken perspective view of the liquid jet head 10 according to the present embodiment.

As shown in FIG. 2, the liquid jet head 10 is provided with a jet section 300, a control circuit board 305, and a pressure buffer 306 disposed on bases 801, 802, wherein the jet section 300 ejects the ink droplet to the recording target medium S (see FIG. 1), the control circuit board 305 is electrically connected to the jet section 300, and the pressure buffer 306 intervenes between the jet section 300 and the liquid supply tube 201 respectively via connecting sections 307, 308. The pressure buffer 306 is for making the ink flow from the liquid supply tube 201 to the jet section 300 while buffering the pressure fluctuation of the ink. It should be noted that it is also possible for the bases 801, 802 to be formed integrally.

The jet section 300 is provided with a flow channel member 301, a liquid jet head chip 303, and a flexible wiring member 304, wherein the flow channel member 301 is connected to the pressure buffer 306 via the connecting section 302, the liquid jet head chip 303 ejects the ink toward the recording target medium S as a droplet in response to application of a voltage, and the flexible wiring member 304 is electrically connected to the liquid jet head chip 303 and the control circuit board 305, and applies the voltage to the liquid jet head chip 303.

It should be noted that the configurations shown in FIG. 1 and FIG. 2 are illustrative only, and the configuration of the liquid jet device 1 and the configuration of the liquid jet head 10 are not limited thereto.

(Electrical Configuration of Liquid Jet Device 1)

Then, an electrical configuration example of the liquid jet device 1 will be described.

Figure 3:
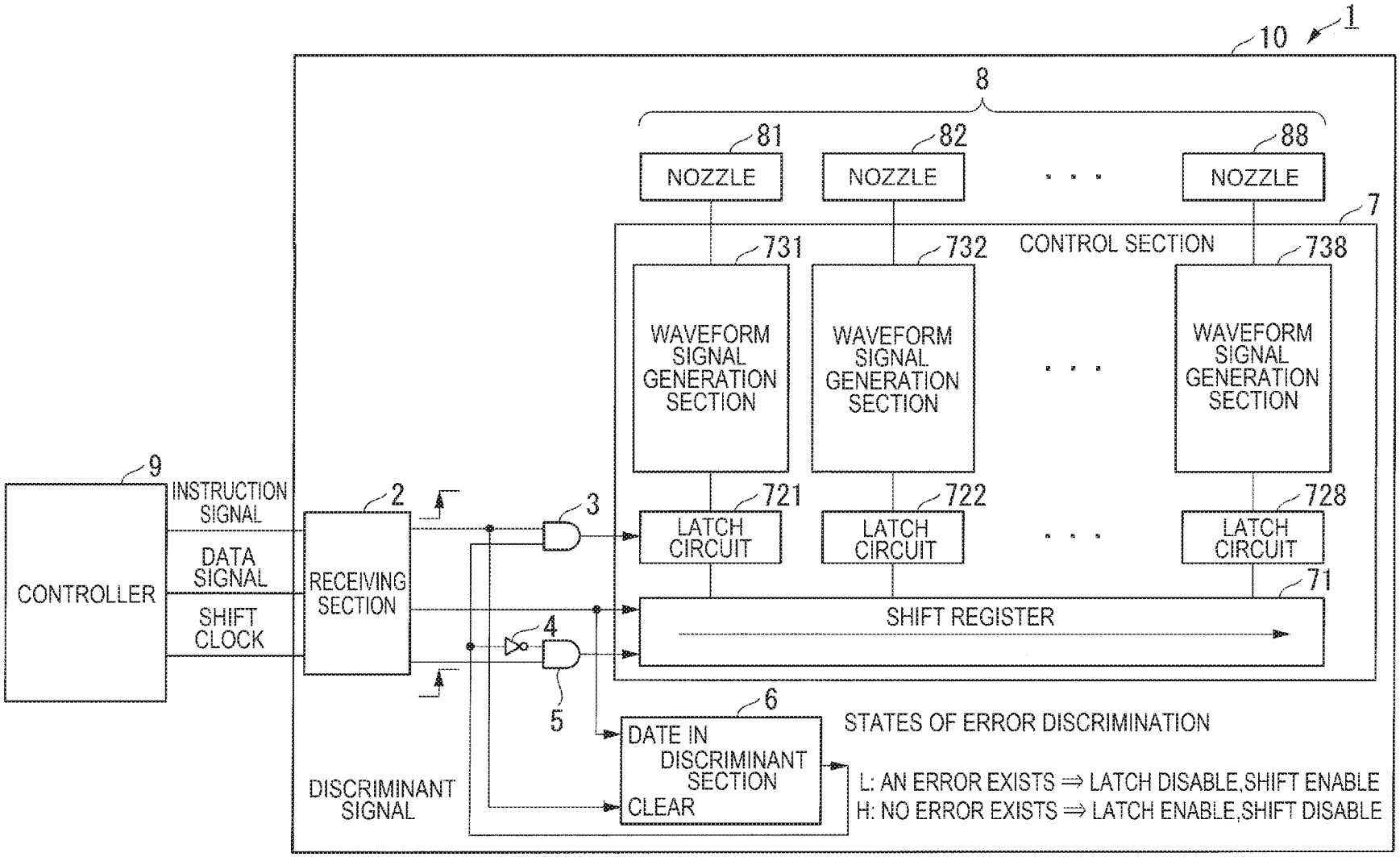
FIG. 3 is a diagram showing a schematic configuration example of the liquid jet device according to the embodiment.

FIG. 3 is a diagram showing a schematic configuration example of the liquid jet device 1 according to the present embodiment. As shown in FIG. 3, the liquid jet device 1 is provided with the liquid jet heads 10 and the controller 9.

The liquid jet heads 10 are each provided with a receiving section 2, an AND circuit 3, a NOT circuit 4, an AND circuit 5, a discriminant section 6, a control section 7, and nozzles 8.

The control section 7 is provided with a shift register 71, latch circuits 721 through 728, and waveform signal generation section 731 through 738. It should be noted that the latch circuits 721 through 728 are referred to as latch circuits 72 unless one of the latch circuits 721 through 728 is identified. Further, the waveform signal generation sections 731 through 738 are referred to as waveform signal generation sections 73 unless one of the waveform signal generation sections 731 through 738 is identified.

The nozzles 8 include nozzles 81 through 88.

The liquid jet device 1 performs printing by jetting the ink from the nozzles 8 in accordance with signals (a data signal (a DATA signal), a shift clock signal (SHIFT CLOCK), and an instruction signal) output by the controller 9. The liquid jet device 1 is, for example, an inkjet printer. Further, the print data included in the data signal is, for example, a pixel data packet.

The controller 9 controls printing by the liquid jet device 1. The controller 9 is, for example, a CPU (central processing unit) or an FPGA (field programmable gate array).

The receiving section 2 receives the signals (the data signal, the shift clock signal, and the instruction signal) output by the controller 9. The receiving section 2 outputs the instruction signal received to one input end of the AND circuit 3, and a CLEAR input section of the discriminant section 6. The receiving section 2 outputs the data signal thus received to a first input end of the shift register 71 of the control section 7, and a DATA IN end of the discriminant section 6. The receiving section 2 outputs the shift clock signal thus received to one input end of the AND circuit 5.

To the one input end of the AND circuit 3, there is input the instruction signal from the receiving section 2, and to the other input end thereof, there is input a discriminant signal from the discriminant section 6, and the AND circuit 3 performs a logical operation of AND on the instruction signal and the discriminant signal to output the result to the latch circuit 721 of the control section 7.

To an input end of the NOT circuit 4, there is input the discriminant signal from the discriminant section 6, and the NOT circuit 4 performs logical inversion on the discriminant signal thus input, and then output the result to one input end of the AND circuit 5.

To the one input end of the AND circuit 5, there is input the discriminant signal having logically been inverted from the NOT circuit 4, to the other input end thereof, there is input the shift clock signal from the receiving section 2, and the AND circuit 5 performs a logical operation of AND on the discriminant signal and the shift clock signal to output the result to a second input end of the shift register 71 of the control section 7.

To the DATA IN input end of the discriminant section 6, there is input the data signal from the receiving section 2, and to the CLEAR input end thereof, there is input the instruction signal from the receiving section 2. The discriminant section 6 performs error discrimination, namely whether or not an error exists, on the print data included in the data signal input between the instruction signals. It should be noted that the error discrimination method will be described later. In the case in which it has been discriminated that no error exists in the print data, the discriminant section 6 outputs the discriminant signal in the H (high) level representing the discrimination result to the one input end of the AND circuit 3 and the input end of the NOT circuit 4, and keeps the discriminant signal until the next instruction signal comes. In the case in which it has been discriminated that an error exists in the print data, the discriminant section 6 outputs the discriminant signal in the L (low) level to the one input end of the AND circuit 3 and the input end of the NOT circuit 4.

The control section 7 is, for example, a driver IC (integrated circuit). The control section 7 writes the print data included in the data signal output by the receiving section 2 into the shift register 71 in accordance with the signals output by the AND circuit 3 and the AND circuit 5, and the latch circuits 72 latch (hold) the print data. The control section 7 performs the control so as to perform printing based on the print data held by the latch circuits 72.

The shift register 71 writes the print data included in the signal output by the receiving section 2 at every timing of the shift clock signal, and then performs or does not perform the shift operation on the print data in accordance with the discrimination result of the discriminant section 6.

In the case in which no error exists in the print data, the discriminant signal is in the H level, and therefore, the output of the NOT circuit 4 is in the L level (SHIFT DISABLE). The AND circuit 5 performs the AND operation on the discriminant signal and the shift clock signal when the shift clock signal rises, and then outputs the L level as a result. The L level of the output of the AND circuit 5 represents the fact that the shift operation is not performed. Therefore, the shift register 71 does not perform the shift operation on the print data.

In the case in which an error exists in the print data, the discriminant signal is in the L level, and therefore, the output of the NOT circuit 4 is in the H level (SHIFT ENABLE). The AND circuit 5 performs the AND operation on the discriminant signal and the shift clock signal when the shift clock signal rises, and then outputs the H level as a result. The H level of the output of the AND circuit 5 represents the fact that the shift operation is to be performed. Therefore, the shift register 71 performs the shift operation on the print data.

The latch circuits 72 perform or do not perform the latch operation on the print data having been written in the shift register 71, in accordance with the discrimination result of the discriminant section 6.

In the case in which no error exists in the print data, the discriminant signal is in the H level, and therefore, the one input end of the AND circuit 3 is in the H level (LATCH ENABLE). The AND circuit 3 performs the AND operation on the discriminant signal and the instruction signal when the instruction signal rises, and then outputs the H level as a result. The H level of the output of the AND circuit 3 represents the fact that the latch operation is to be performed. Therefore, the latch circuits 72 perform the latch operation on the print data written in the shift register 71.

In the case in which an error exists in the print data, the discriminant signal is in the L level, and therefore, the one input end of the AND circuit 3 is in the L level (LATCH DISABLE). The AND circuit 3 performs the AND operation on the discriminant signal and the instruction signal when the instruction signal rises, and then outputs the L level as a result. The L level of the output of the AND circuit 3 represents the fact that the latch operation is not performed. Therefore, the latch circuits 72 do not perform the latch operation on the print data written in the shift register 71.

The waveform signal generation sections 73 each generate the waveform signal corresponding to the print data on which the latch circuits 72 have performed the latch operation, and then make the respective nozzles 8 eject the ink using the waveform signals thus generated.

The nozzles 8 jet the ink in accordance with the waveform signals generated by the waveform signal generation sections 73, respectively. It should be noted that it is possible to provide a drive circuit between the waveform signal generation section 73 and the nozzle 8.

It should be noted that although there is described the example in which the eight nozzles 8 are provided in the example shown in FIG. 3, this is not a limitation.

Then, a configuration example of the data signal output by the controller 9, and a timing example of the signals will be described.

Firstly, the processing example of the case in which no error exists in the print data included in the data signal received from the controller 9 will be described.

Figure 4:
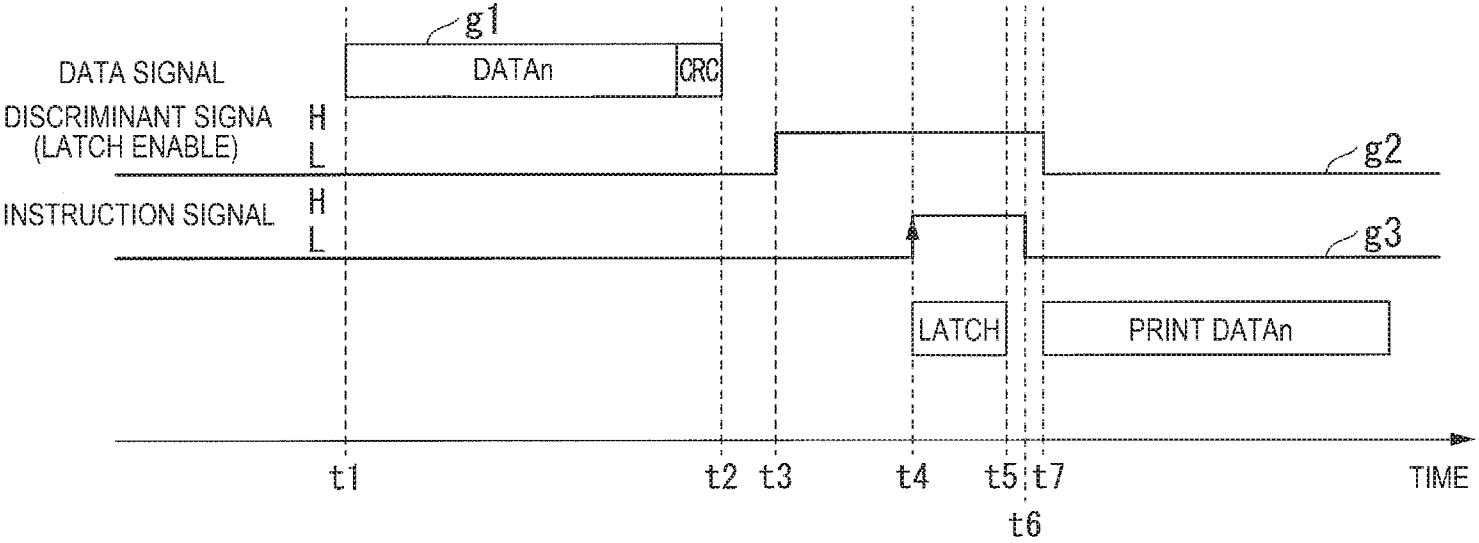
FIG. 4 is a diagram showing a processing example of the case in which no error exists in print data included in a data signal related to the first embodiment.

FIG. 4 is a diagram showing a processing example of the case in which no error exists in the print data included in the data signal related to the present embodiment. In FIG. 4, the horizontal axis represents time. The reference symbol g1 denotes the data signal. The waveform g2 represents the discriminant signal. The waveform g3 represents the instruction signal. It should be noted that in FIG. 4, the shift clock signal is omitted from the illustration. It should be noted that in the example shown in FIG. 4, it is assumed that before the time t1, $data_{n-1}$ is included in the data signal transmitted previous to data", no error exists in the $data_{n-1}$, and the $data_{n-1}$ has already been held.

In the example shown in FIG. 4, the data signal includes the $data_n$, and CRC (cyclic redundancy check) used for the error discrimination. It should be noted that the detection of the error in the print data is not limited to the CRC, but it is also possible to use, for example, a check sum, or a parity code.

In the period from the time t1 to the time t2, the receiving section 2 receives the data signal output by the controller 9.

At the time t3, since no error exists in the $data_n$ as a result of the discrimination on whether or not an error exists in the $data_n$ as the print data included in the data signal, the discriminant section 6 changes the discriminant signal from the L level to the H level.

After predetermined time elapses from when outputting the data signal, namely at the time t4, the controller 9 changes the instruction signal from the L level to the H level. In the period from the time t4 to the time t6, the controller 9 keeps the instruction signal in the H level.

In the period from the time t4 to the time t5, since the discriminant signal is in the H level, and therefore, the output of the AND circuit 3 is in the H level, the latch circuits 72 perform the latch operation on the $data_n$ to hold the $data_n$. Thus, the $data_{n-1}$ held by the latch circuits 72 is rewritten with the $data_n$.

At the time t6, the controller 9 restores the instruction signal from the H level to the L level.

At the time t7, the discriminant section 6 restores the discriminant signal from the H level to the L level.

After the time t7, the control section 7 performs printing based on the $data_n$ held by the latch circuits 72 after predetermined time elapses from when the instruction signal has changed from the H level to the L level, namely using the falling edge of the instruction signal as a trigger. It should be noted that it is also possible to arrange that the control section 7 performs printing when, or after the falling edge of the discriminant signal has been detected within a predetermined period from the falling edge of the instruction signal.

Then, the processing example of the case in which an error exists in the print data included in the data signal received from the controller 9 will be described.

Figure 5:
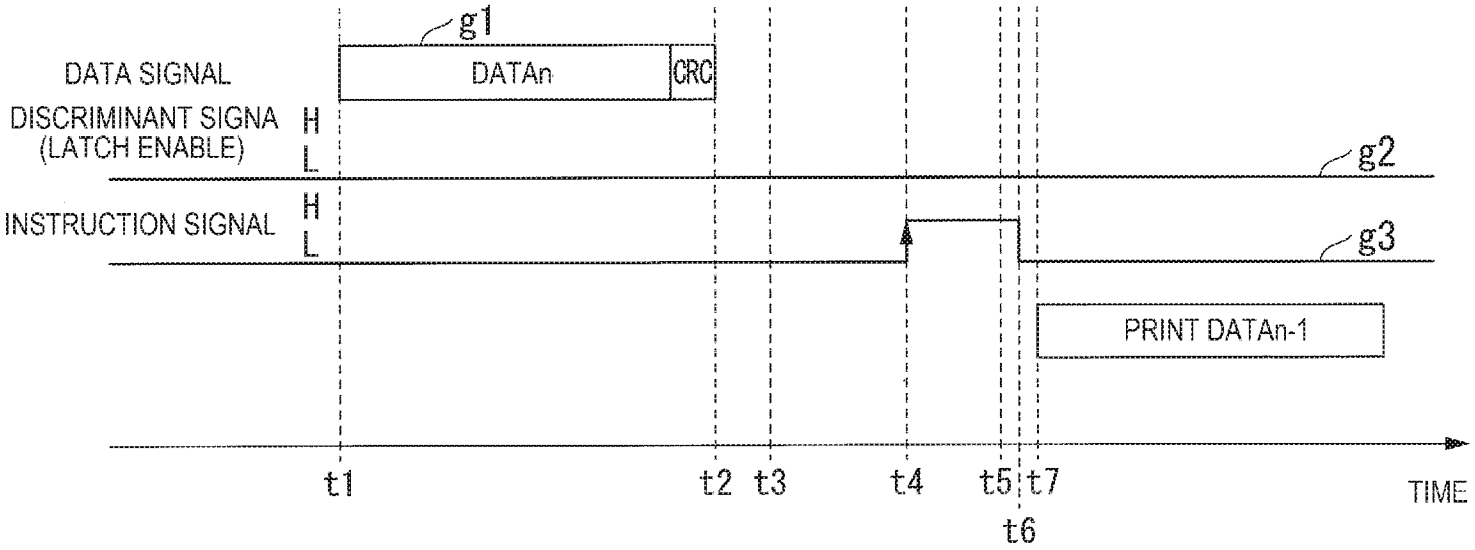
FIG. 5 is a diagram showing a processing example of the case in which an error exists in the print data included in the data signal related to the first embodiment.

FIG. 5 is a diagram showing the processing example of the case in which an error exists in the print data included in the data signal related to the present embodiment. In FIG. 5, the horizontal axis represents time. It should be noted that in the example shown in FIG. 5, similarly to FIG. 4, it is assumed that before the time t1, the $data_{n-1}$ is included in the data signal transmitted previous to the $data_n$, no error exists in the $data_{n-1}$, and the $data_{n-1}$ has already been held.

In the period from the time t1 to the time t2, the receiving section 2 receives the data signal output by the controller 9.

At the time t3, since an error exists in the $data_n$ included in the data signal, the discriminant section 6 does not change the discriminant signal to the H level but keeps the discriminant signal in the L level.

After predetermined time elapses from when outputting the data signal, namely at the time t4, the controller 9 changes the instruction signal from the L level to the H level. In the period from the time t4 to the time t6, the controller 9 keeps the instruction signal in the H level.

In the period from the time t4 to the time t5, since the discriminant signal is in the L level, and therefore, the output of the AND circuit 3 is in the L level, the latch circuits 72 do not perform the latch operation on the $data_n$. Therefore, the latch circuits 72 keep holding the $data_{n-1}$.

At the time t6, the controller 9 restores the instruction signal from the H level to the L level.

After the time t7, the control section 7 performs printing based on the $data_{n-1}$ held by the latch circuits 72 after predetermined time elapses from when the instruction signal has changed from the H level to the L level, namely using the falling edge of the instruction signal as a trigger.

As described using FIG. 4 and FIG. 5, in the present embodiment, the control section 7 performs printing while holding the print data received in the case in which no error exists in the print data thus received, or does not hold the print data received in the case in which an error exists in the print data thus received, and performs printing with the print data which does not include an error, and is therefore held by the control section 7. If the error does not frequently occurs, the print data held is the print data received last time, therefore, according to the present embodiment, if printing is performed based on the print data instead of the print data received this time, it is possible to reduce the uncomfortable feeling such as one caused by a void.

Then, there will be described an example of a process performed by the liquid jet device 1 in the case in which the controller 9 outputs the data signal at every predetermined time.

Figure 6:
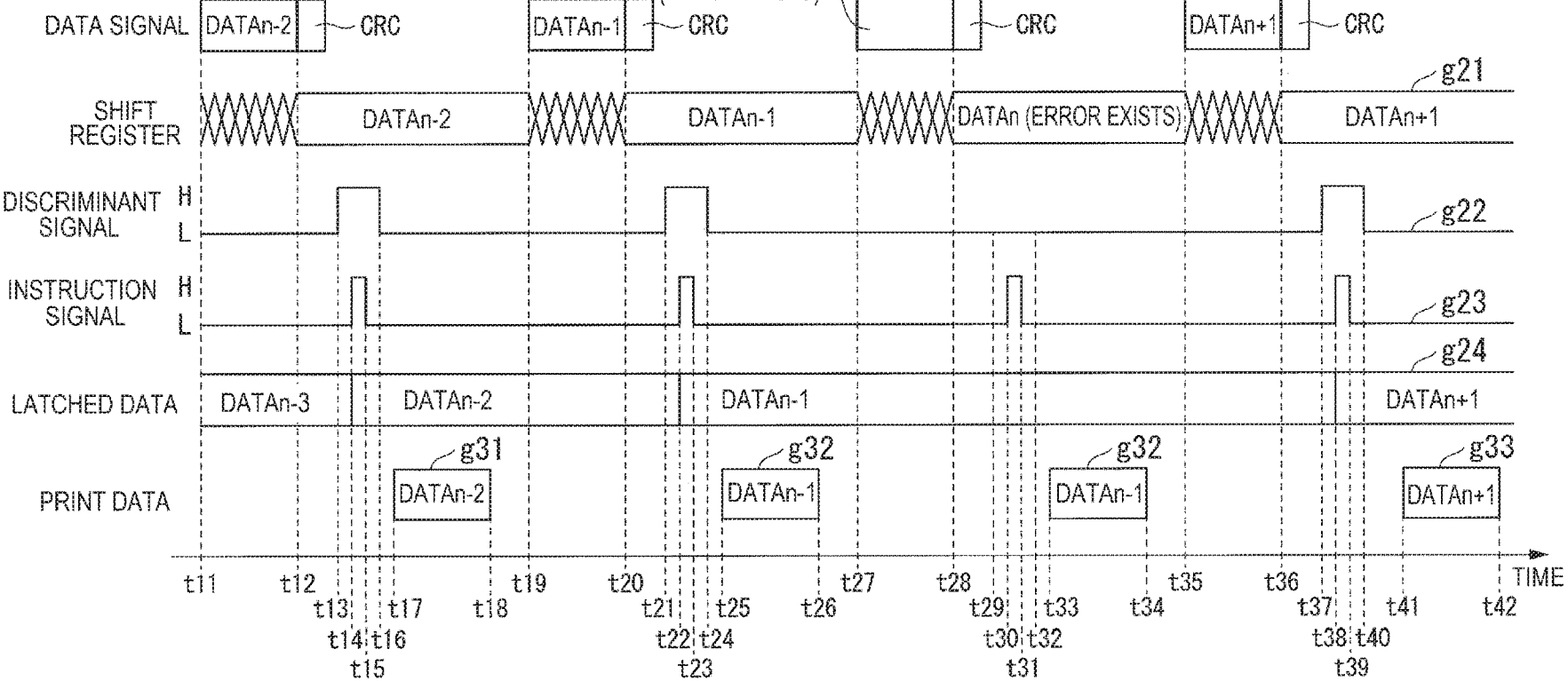
FIG. 6 is a timing chart showing an example of a process performed by the liquid jet device in the case in which a controller according to the first embodiment outputs the data signal at every predetermined time.

FIG. 6 is a timing chart showing an example of a process performed by the liquid jet device 1 in the case in which a controller according to the first embodiment outputs the data signal at every predetermined time. In FIG. 6, the horizontal axis represents time. The reference symbols g11 through g14 each denote the data signal. The reference symbol g21 denotes the print data to be written into the shift register. The waveform g22 represents the discriminant signal. The waveform g23 represents the instruction signal. The reference symbol g24 denotes the print data latched by the latch circuits 72. The reference symbols g31 through g33 each denote the print data with which printing is performed. Further, it is assumed that before the time t11, the data signal including $data_{n-3}$ is received, and no error exists in the $data_{n-3}$, and therefore the $data_{n-3}$ is held in the latch circuits 72.

In the period from the time t11 to the time t12, the receiving section 2 receives the data signal g11 including the $data_{n-2}$ output by the controller 9.

At the time t12, there is obtained the state in which the $data_{n-2}$ is written into the shift register 71.

At the time t13, since no error exists in the $data_{n-2}$ as a result of the discrimination on whether or not an error exists in the print data based on the CRC on the $data_{n-2}$ included in the data signal, the discriminant section 6 changes the discriminant signal from the L level to the H level. It should be noted that the discriminant section 6 checks the CRC, namely performs the discrimination on whether or not an error exists, in the period from the time t12 to the time t13.

After predetermined time elapses from when outputting the data signal, namely at the time t14, the controller 9 changes the instruction signal from the L level to the H level. In the period from the time t14 to the time t15, the controller 9 keeps the instruction signal in the H level.

At the time t14, since the discriminant signal is in the H level, and therefore, the output of the AND circuit 3 is in the H level, the latch circuits 72 perform the latch operation on the $data_n$ having already been written in the shift register 71 to hold the $data_{n-2}$. Thus, the $data_{n-3}$ held by the latch circuits 72 is rewritten with the $data_{n-2}$.

At the time t15, the controller 9 restores the instruction signal from the H level to the L level.

The discriminant section 6 restores the discriminant signal from the H level to the L level after predetermined time elapses from when the instruction signal has changed from the H level to the L level, namely at the time t16.

During the period from the time t17 to the time t18, the control section 7 performs printing based on the $data_{n-2}$ of the print data g31 held by the latch circuits 72 after predetermined time elapses from when the instruction signal has changed from the H level to the L level. It should be noted that it is also possible to arrange that the control section 7 performs printing when, or after the falling edge of the discriminant signal has been detected within a predetermined period from the falling edge of the instruction signal.

Since no error is included in the $data_{n-1}$ included in the data signal thus received in the period from the time t19 to the time t26, the control section 7 performs substantially the same process as in the period from the time t11 to the time t18. Thus, at the time t22, the latch circuits 72 perform the latch operation on the $data_{n-1}$ written in the shift register 71 to hold the $data_{n-1}$. As a result, the $data_{n-2}$ held by the latch circuits 72 is rewritten with the $data_{n-1}$. Then, during the period from the time t25 to the time t26, the control section 7 performs printing based on the $data_{n-1}$ of the print data g32 held by the latch circuits 72 after predetermined time elapses from when the instruction signal has changed from the H level to the L level. It should be noted that it is also possible to arrange that the control section 7 performs printing when, or after the falling edge of the discriminant signal has been detected within a predetermined period from the falling edge of the instruction signal.

In the period from the time t27 to the time t28, the receiving section 2 receives the data signal g13 including the $data_n$ output by the controller 9.

At the time t29, since an error exists in the data as a result of the discrimination on whether or not an error exists based on the CRC on the $data_n$ included in the data signal, the discriminant section 6 does not change the discriminant signal from the L level to the H level.

After predetermined time elapses from when outputting the data signal, namely at the time t30, the controller 9 changes the instruction signal from the L level to the H level. In the period from the time t30 to the time t31, the controller 9 keeps the instruction signal in the H level.

At the time t30, since the discriminant signal is in the L level, and therefore, the output of the AND circuit 3 is in the L level, the latch circuits 72 do not perform the latch operation on the $data_n$ having already been written in the shift register 71, but keep holding the $data_{n-1}$.

At the time t31, the controller 9 restores the instruction signal from the H level to the L level.

During the period from the time t33 to the time t34, the control section 7 performs printing based on the $data_{n-1}$ of the print data g32 with no error held by the latch circuits 72 after predetermined time elapses from when the instruction signal has changed from the H level to the L level.

Since no error is included in the $data_{n+1}$ included in the data signal thus received in the period from the time t35 to the time t42, the control section 7 performs substantially the same process as in the period from the time t11 to the time t18. Thus, at the time t38, the latch circuits 72 perform the latch operation on the $data_{n+1}$ written in the shift register 71 to hold the $data_{n+1}$. As a result, the $data_{n-1}$ held by the latch circuits 72 is rewritten with the $data_{n+1}$. Then, during the period from the time t41 to the time t42, the control section 7 performs printing based on the $data_{n+1}$ of the print data g33 held by the latch circuits 72 after predetermined time elapses from when the instruction signal has changed from the H level to the L level. It should be noted that it is also possible to arrange that the control section 7 performs printing when, or after the falling edge of the discriminant signal has been detected within a predetermined period from the falling edge of the instruction signal.

As described above, in the present embodiment, it is arranged that the error discrimination is performed based on the CRC on the print data included in the transmission signal (the data signal) transmitted by the controller 9. Further, in the present embodiment, it is arranged that in the case in which an error exists in the print data, the print data with the error is not held, but the print data with no error and held currently is used for printing.

Thus, according to the present embodiment, the error check in the print data is performed on the liquid jet head side, and in the case in which the error occurs in the print data, printing is performed using the normal print data held currently. Therefore, it is possible to improve the print quality. Further, the liquid jet head performs the error check and the error handling process by itself, and there is no need to transmit the response signal to the print data received to the host side which has transmitted the print data. Thus, the upstream high-speed signal lines for the response signal and the retry signal become unnecessary for the connection between the liquid jet head side and the host.

Further, according to the present embodiment, even in the case in which an error exists in the print data received, it is possible to prevent the void by performing printing using the print data currently held such as the pixel data packet of the previous line. Thus, according to the present embodiment, it is possible to improve the printing performance. Further, according to the present embodiment, since the liquid jet device 1 does not transmit the result of the reception, the error signal, and so on to the controller 9, it is possible for the controller 9 to transmit the transmission signal to the liquid jet device 1 without performing the error processing. Alternately, it is also possible to arrange that the liquid jet head 10A announce that the liquid jet head 10A has detected the error to the controller 9 in the case in which the liquid jet head 10A has detected the error.

Here, a modified example of the present embodiment will be described.

Figure 7:
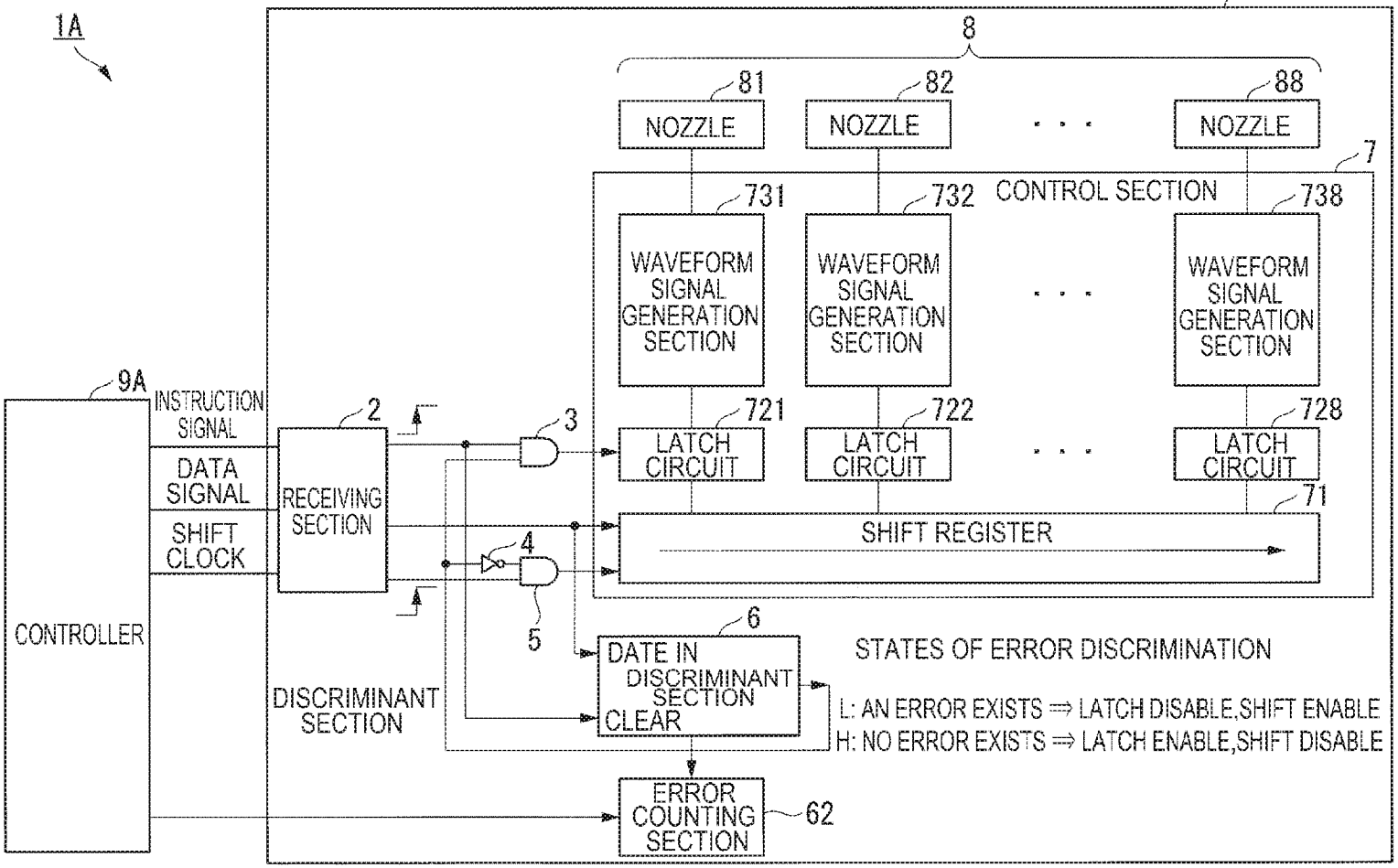
FIG. 7 is a diagram showing a modified example of the schematic configuration of the liquid jet device according to the embodiment.

FIG. 7 is a diagram showing a modified example of the schematic configuration of the liquid jet device 1A according to the present embodiment. As shown in FIG. 7, the liquid jet device 1A is provided with the liquid jet heads 10A and a controller 9A.

The liquid jet heads 10A are each provided with the receiving section 2, the AND circuit 3, the NOT circuit 4, the AND circuit 5, the discriminant section 6, an error counting section 62, the control section 7, and the nozzles 8.

The differences from the liquid jet device 1 shown in FIG. 3 are the error counting section 62 and the controller 9A.

The error counting section 62 counts the number of times of the occurrence of the error (the number of errors) in the result of the error determination performed by the discriminant section 6 on the print data, and then stores the number.

The controller 9A reads out the number of errors stored by the error counting section 62 at every predetermined time (e.g., every 1 second). It is also possible for the controller 9A to be arranged to perform the error processing based on the number of errors thus read out. For example, it is possible for the controller 9A to stop the transmission of the transmission signal (the data signal) in the case in which the number of errors thus read out is equal to or larger than a threshold value. Alternatively, it is also possible to arrange that the liquid jet head 10A announce that the liquid jet head 10A has counted the number of errors to a level equal to or higher than a predetermined level to the controller 9 in the case in which the liquid jet head 10A has counted the number of errors to the level equal to or higher than the predetermined level.

Thus, according to the modified example, it is also possible to abort the printing in the case in which the errors occur continuously. As a result, according to the modified example, it is possible to make use of the invention for the reliability evaluation and the improvement of the reliability of the system itself.

Second Embodiment

In the first embodiment, there is described the example in which the controller 9 transmits the data signal once between the instruction signals. However, the number of times of the transmission can also be two or more times. In the present embodiment, there is described an example in which the controller 9 transmits the data signal three times between the instruction signals using FIG. 8 through FIG.

11. It should be noted that the liquid jet device 1 is substantially the same as in FIG. 3.

Figure 8:
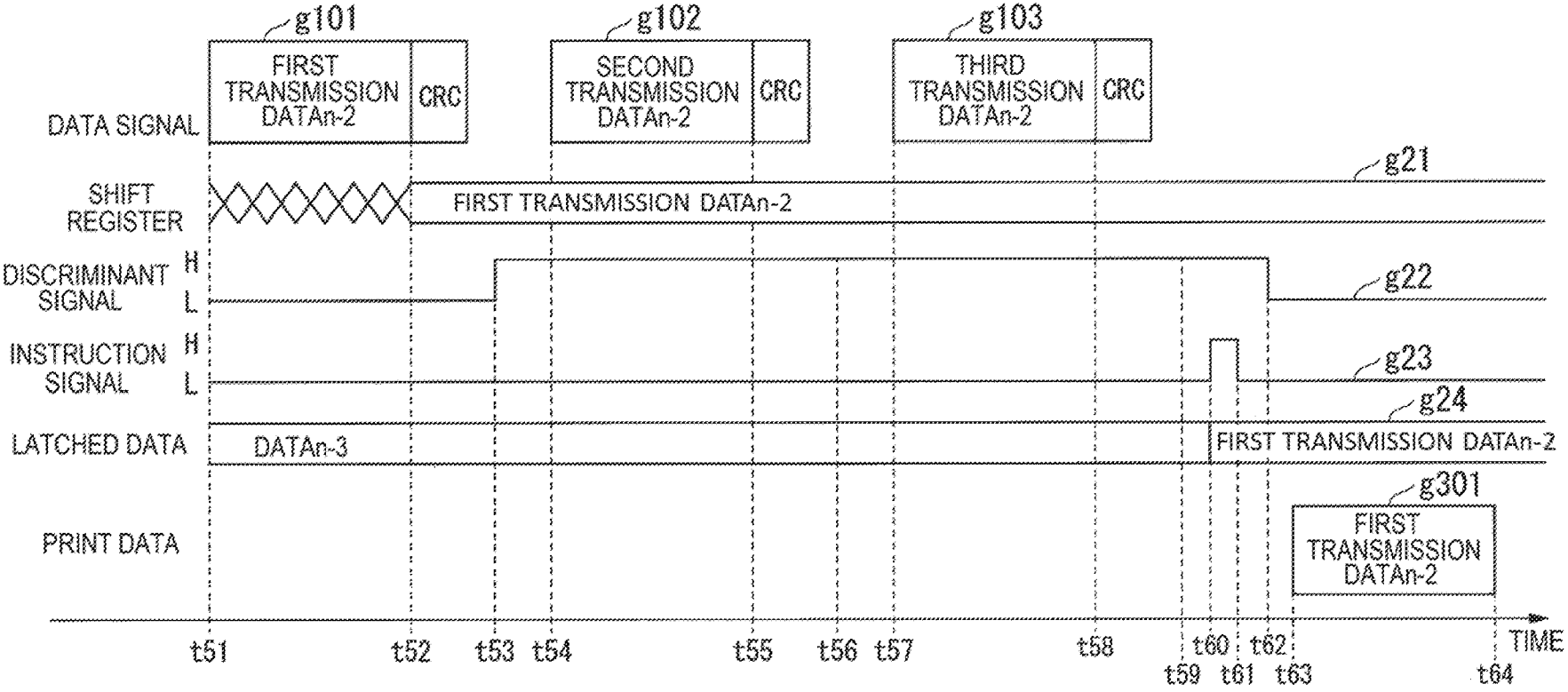
FIG. 8 is a timing chart showing an example of a process performed by the liquid jet device in the case in which no error exists in all of three print data received between instruction signals related to a second embodiment.
Figure 9:
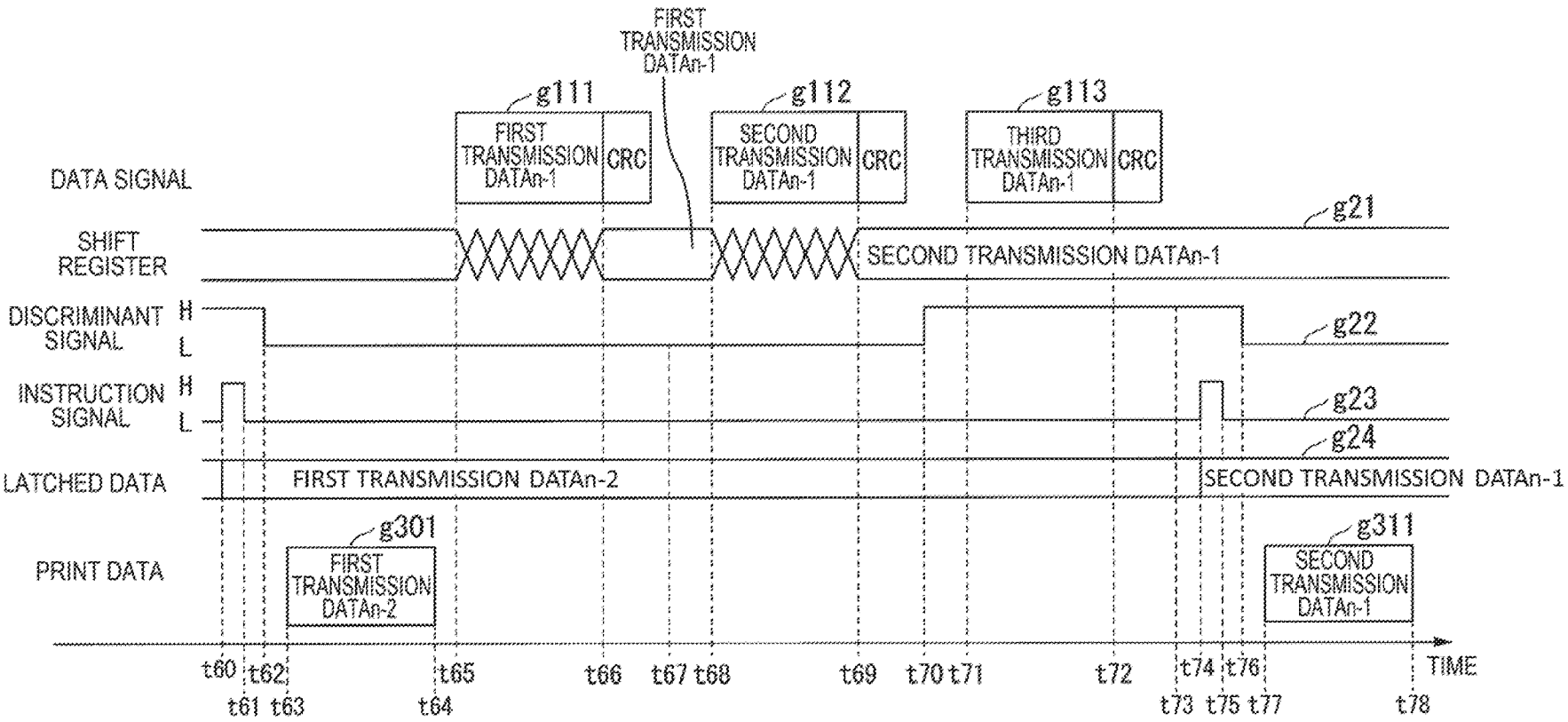
FIG. 9 is a timing chart showing an example of a process performed by the liquid jet device in the case in which an error exists in first one of the three print data received between the instruction signals related to the second embodiment.
Figure 10:
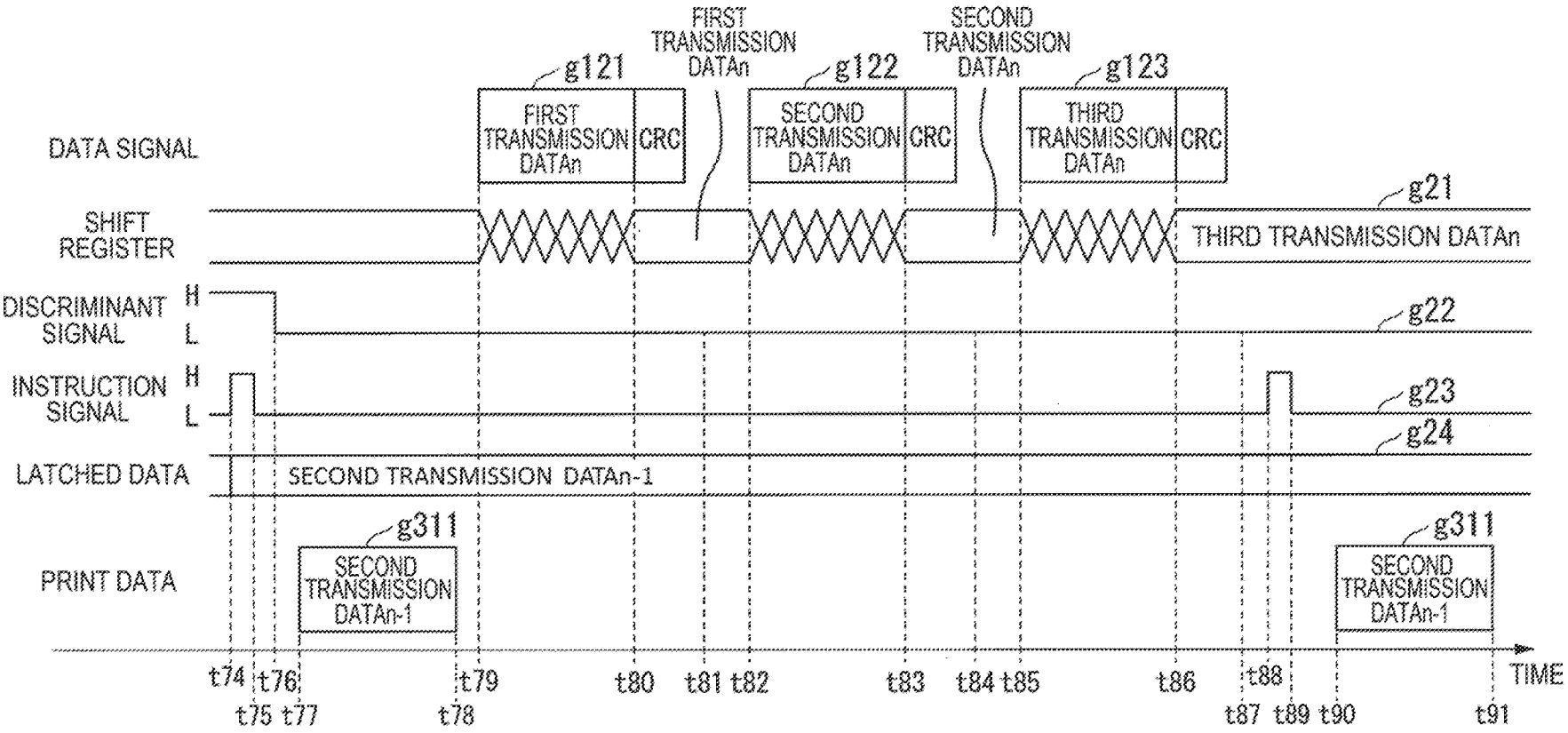
FIG. 10 is a timing chart showing an example of a process performed by the liquid jet device in the case in which an error exists in each of the three print data received between the instruction signals related to the second embodiment.
Figure 11:
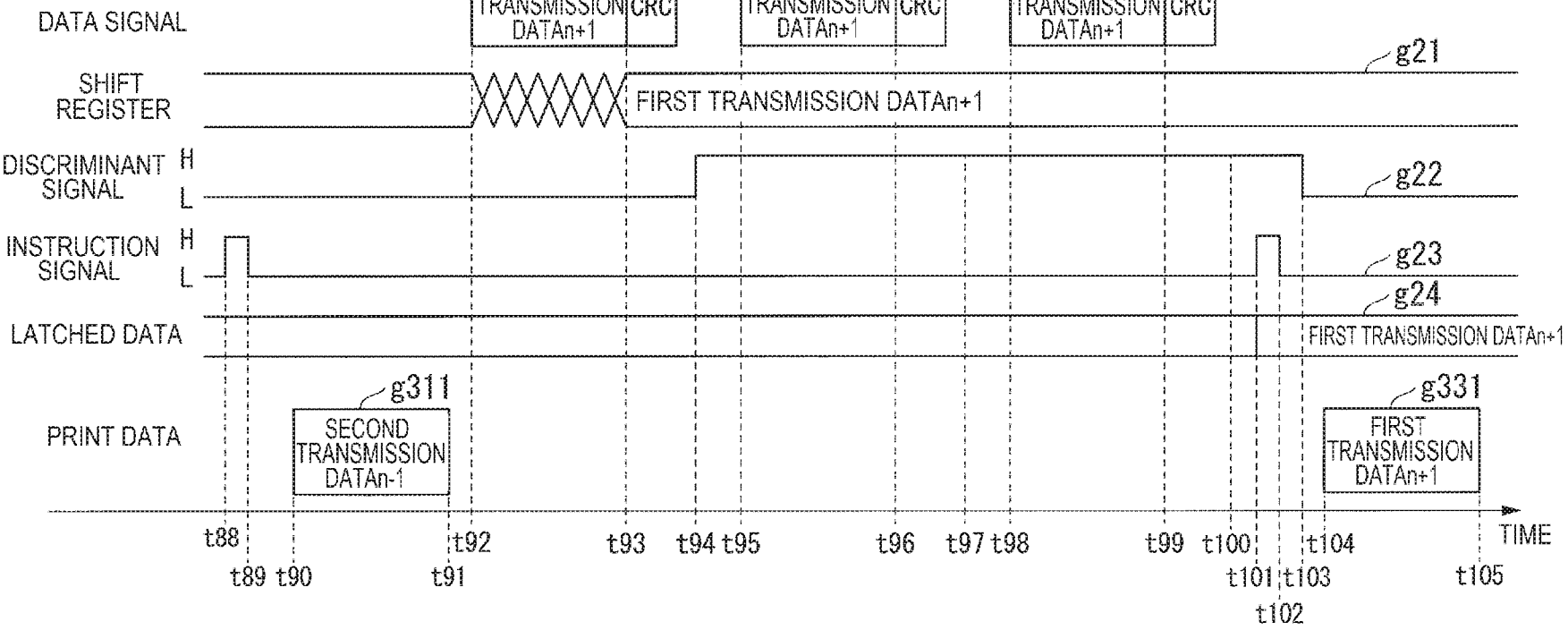
FIG. 11 is a timing chart showing an example of a process performed by the liquid jet device in the case in which an error exists in second one of the three print data received between the instruction signals related to the second embodiment.

FIG. 8 is a timing chart showing an example of a process performed by the liquid jet device 1 in the case in which no error exists in all of three print data received between instruction signals related to the present embodiment. FIG. 9 is a timing chart showing an example of a process performed by the liquid jet device 1 in the case in which an error exists in first one of the three print data received between the instruction signals related to the present embodiment. FIG. 10 is a timing chart showing an example of a process performed by the liquid jet device 1 in the case in which an error exists in all of the three print data received between instruction signals related to the present embodiment. FIG. 11 is a timing chart showing an example of a process performed by the liquid jet device 1 in the case in which an error exists in second one of the three print data received between the instruction signals related to the present embodiment.

In FIG. 8 through FIG. 11, the horizontal axis represents time. The reference symbol g21 denotes the print data to be written into the shift register 71. The waveform g22 represents the discriminant signal. The waveform g23 represents the instruction signal. The reference symbol g24 denotes the print data latched by the latch circuits 72.

Firstly, FIG. 8 will be described. In FIG. 8, the reference symbols g101 through g103 each denote the data signal. The reference symbol g21 denotes the print data to be written into the shift register 71. The reference symbols g301 denotes the print data with which printing is performed. Further, it is assumed that before the time t51, the data signal including $data_{n-3}$ is received, and no error exists in the $data_{n-3}$, and therefore the $data_{n-3}$ is held in the latch circuits 72.

Here, the first data signal transmitted between the instruction signals is referred to as a first transmission signal, the second data signal is referred to as a second transmission signal, and the third data signal is referred to as a third transmission signal. It should be noted that the print data included in each of the first transmission signal, the second transmission signal, and the third transmission signal includes the same data, but can also include different data (e.g., information representing a transmission sequence of the transmission signal) besides the print data. It should be noted that the example shown in FIG. 8 is an example in which it has been determined that no error exists in each of the first transmission signal g101, the second transmission signal g102, and the third transmission signal g103, namely no error exists.

In the period from the time t51 to the time t52, the receiving section 2 receives the first transmission signal g101 including the first transmission $data_{n-2}$ output by the controller 9.

At the time t52, the first transmission $data_{n-2}$ is written into the shift register 71. In the present embodiment, in the case of receiving a plurality of transmission signals (data signals) between the instruction signals, the shift register 71 holds the first transmission $data_{n-2}$ included in the first transmission signal g101, which is one received at the earliest time of the error free transmission signals received between the instruction signals. The shift register 71 performs the shift operation of the print data if the discriminant signal is in the L level, or neglects the subsequent print data and does not perform the shift operation of the print data if the discriminant signal is in the H level.

At the time t53, since no error exists in the first transmission $data_{n-2}$ as a result of the discrimination on whether or not an error exists based on the CRC on the first transmission $data_{n-2}$ included in the first transmission signal g101, the discriminant section 6 changes the discriminant signal from the L level to the H level.

In the period from the time t54 to the time t55, the receiving section 2 receives the second transmission signal g102 including the second transmission $data_{n-2}$ output by the controller 9.

At the time t55, since no error exists in the first transmission signal g101, the discriminant signal is in the H level. Therefore, the second transmission $data_{n-2}$ is not written into the shift register 71.

At the time t56, the discriminant section 6 discriminates that no error exists in the second transmission $data_{n-2}$ as a result of the discrimination on whether or not an error exists based on the CRC on the second transmission $data_{n-2}$ included in the second transmission signal g102. In this case, since no error exists in the first transmission signal g101, and the last discriminant signal is in the H level, the discriminant section 6 keeps the discriminant signal in the H level.

In the period from the time t57 to the time t58, the receiving section 2 receives the third transmission signal g103 including the third transmission $data_{n-2}$ output by the controller 9.

At the time t58, since no error exists in the first transmission signal g101, the discriminant signal is in the H level. Therefore, the third transmission $data_{n-2}$ is not written into the shift register 71.

At the time t59, the discriminant section 6 discriminates that no error exists in the third transmission $data_{n-2}$ as a result of the discrimination on whether or not an error exists based on the CRC on the third transmission $data_{n-2}$ included in the third transmission signal g103. In this case, since no error exists in the first transmission signal g101, and the last discriminant signal is in the H level, the discriminant section 6 keeps the discriminant signal in the H level.

It should be noted that the discriminant section 6 can also be arranged not to discriminate whether or not an error exists in the print data on the second transmission signal g102 and the third transmission signal g103 since no error exists in the first transmission signal g101.

After predetermined time elapses from when outputting the third transmission signal g103, namely at the time t60, the controller 9 changes the instruction signal from the L level to the H level. In the period from the time t60 to the time t61, the controller 9 keeps the instruction signal in the H level.

At the time t60, since the discriminant signal is in the H level, and therefore, the output of the AND circuit 3 is in the H level, the latch circuits 72 perform the latch operation on the first transmission $data_{n-2}$ held by the shift register 71 to rewrite the $data_{n-3}$ with the first transmission $data_{n-2}$.

At the time t61, the controller 9 restores the instruction signal from the H level to the L level.

The discriminant section 6 restores the discriminant signal from the H level to the L level after predetermined time elapses from when the instruction signal has changed from the H level to the L level, namely at the time t62.

During the period from the time t63 to the time t64, the control section 7 performs generation of the waveform signal (ejection waveform) based on the first transmission $data_{n-2}$ of the print data g301 held by the latch circuits 72, and then performs printing based on the waveform signal thus generated after predetermined time elapses from when the instruction signal has changed from the H level to the L level. It should be noted that it is also possible to arrange that the control section 7 performs printing when, or after the falling edge of the discriminant signal has been detected within a predetermined period from the falling edge of the instruction signal.

Then, making the transition to FIG. 9, the explanation will be continued. The example shown in FIG. 9 is an example of the case in which an error exists in the first print data of the three print data received between the instruction signals.

In the period from the time t65 to the time t66, the receiving section 2 receives the first transmission signal g111 including the first transmission $data_{n-1}$ output by the controller 9.

At the time t66, the shift register 71 is in the state in which the first transmission $data_{n-1}$ is written therein.

At the time t67, since an error exists in the first transmission $data_{n-1}$ as a result of the discrimination on whether or not an error exists based on the CRC on the first transmission $data_{n-1}$ included in the first transmission signal g111, the discriminant section 6 keeps the discriminant signal in the L level.

In the period from the time t68 to the time t69, the receiving section 2 receives the second transmission signal g112 including the second transmission $data_{n-1}$ output by the controller 9.

At the time t69, the shift register 71 is in the state in which the second transmission $data_{n-1}$ is written therein. In the present embodiment, as described above, in the case of receiving a plurality of transmission signals (data signals) between the instruction signals, the shift register 71 holds the second transmission $data_{n-1}$ included in the second transmission signal g112, which is one received at the earliest time of the error free transmission signals received between the instruction signals. The shift register 71 performs the shift operation of the print data if the discriminant signal is in the L level, or neglects the subsequent print data and does not perform the shift operation of the print data if the discriminant signal is in the H level.

At the time t70, since no error exists in the second transmission $data_{n-1}$ as a result of the discrimination on whether or not an error exists based on the CRC on the second transmission $data_{n-1}$ included in the second transmission signal g112, the discriminant section 6 changes the discriminant signal from the L level to the H level.

In the period from the time t71 to the time t72, the receiving section 2 receives the third transmission signal g113 including the third transmission $data_{n-1}$ output by the controller 9.

At the time t72, since no error exists in the second transmission signal g112, the discriminant signal is in the H level. Therefore, the third transmission $data_{n-1}$ is not written into the shift register 71, and the shift register 71 is kept in the state in which the second transmission $data_{n-1}$ is written therein.

At the time t73, the discriminant section 6 discriminates that no error exists in the third transmission $data_{n-1}$ as a result of the discrimination on whether or not an error exists based on the CRC on the third transmission $data_{n-1}$ included in the third transmission signal g113. In this case, since no error exists in the second transmission signal g112, and the last discriminant signal is in the H level, the discriminant section 6 keeps the discriminant signal in the H level.

It should be noted that the discriminant section 6 can also be arranged not to discriminate whether or not an error exists on the third transmission signal g113 since no error exists in the second transmission signal g112.

After predetermined time elapses from when outputting the third transmission signal g113, namely at the time t74, the controller 9 changes the instruction signal from the L level to the H level. In the period from the time t74 to the time t75, the controller 9 keeps the instruction signal in the H level.

At the time t74, since the discriminant signal is in the H level, and therefore, the output of the AND circuit 3 is in the H level, the latch circuits 72 perform the latch operation on the second transmission $data_{n-1}$ having already been written in the shift register 71 to rewrite the first transmission $data_{n-2}$ with the second transmission $data_{n-1}$.

At the time t75, the controller 9 restores the instruction signal from the H level to the L level.

The discriminant section 6 restores the discriminant signal from the H level to the L level after predetermined time elapses from when the instruction signal has changed from the H level to the L level, namely at the time t76.

During the period from the time t77 to the time t78, the control section 7 performs generation of the waveform signal (ejection waveform) based on the second transmission $data_{n-1}$ of the print data g311 held by the latch circuits 72, and then performs printing based on the waveform signal thus generated after predetermined time elapses from when the instruction signal has changed from the H level to the L level. It should be noted that it is also possible to arrange that the control section 7 performs printing when, or after the falling edge of the discriminant signal has been detected within a predetermined period from the falling edge of the instruction signal.

Then, making the transition to FIG. 10, the explanation will be continued. The example shown in FIG. 10 is an example of the case in which an error exists in all of the three print data received between the instruction signals.

In the period from the time t79 to the time t80, the receiving section 2 receives the first transmission signal g121 including the first transmission $data_n$ output by the controller 9.

At the time t80, the shift register 71 is in the state in which the first transmission $data_n$ is written therein.

At the time t81, since an error exists in the first transmission $data_n$ as a result of the discrimination on whether or not an error exists based on the CRC on the first transmission $data_n$ included in the first transmission signal g121, the discriminant section 6 keeps the discriminant signal in the L level.

In the period from the time t82 to the time t83, the receiving section 2 receives the second transmission signal g122 including the second transmission $data_n$ output by the controller 9.

At the time t83, the shift register 71 is in the state in which the second transmission $data_n$ is written therein.

At the time t84, since an error exists in the second transmission $data_n$ as a result of the discrimination on whether or not an error exists based on the CRC on the second transmission $data_n$ included in the second transmission signal g122, the discriminant section 6 keeps the discriminant signal in the L level.

In the period from the time t85 to the time t86, the receiving section 2 receives the third transmission signal g123 including the third transmission $data_n$ output by the controller 9.

At the time t85, the shift register 71 is in the state in which the third transmission $data_n$ is written therein.

At the time t87, since an error exists in the third transmission $data_n$ as a result of the discrimination on whether or not an error exists based on the CRC on the third transmission $data_n$ included in the third transmission signal g123, the discriminant section 6 keeps the discriminant signal in the L level.

After predetermined time elapses from when outputting the third transmission signal g123, namely at the time t88, the controller 9 changes the instruction signal from the L level to the H level. In the period from the time t88 to the time t89, the controller 9 keeps the instruction signal in the H level.

At the time t88, since the discriminant signal is in the L level, and therefore, the output of the AND circuit 3 is in the L level, the latch circuits 72 keep the second transmission $data_{n-1}$.

At the time t89, the controller 9 restores the instruction signal from the H level to the L level.

During the period from the time t90 to the time t91, the control section 7 performs generation of the waveform signal (ejection waveform) based on the second transmission $data_{n-1}$ of the last print data g311 held by the latch circuits 72, and then performs printing based on the waveform signal thus generated after predetermined time elapses from when the instruction signal has changed from the H level to the L level.

Then, making the transition to FIG. 11, the explanation will be continued. The example shown in FIG. 11 is an example of the case in which an error exists in the second print data of the three print data received between the instruction signals.

In the period from the time t92 to the time t93, the receiving section 2 receives the first transmission signal g131 including the first transmission $data_{n+1}$ output by the controller 9.

At the time t93, the shift register 71 is in the state in which the first transmission $data_{n+1}$ is written therein.

At the time t94, since no error exists in the first transmission $data_{n-1}$ as a result of the discrimination on whether or not an error exists based on the CRC on the first transmission $data_{n+1}$ included in the first transmission signal g131, the discriminant section 6 changes the discriminant signal from the L level to the H level.

In the period from the time t95 to the time t96, the receiving section 2 receives the second transmission signal g132 including the second transmission $data_{n+1}$ output by the controller 9.

At the time t96, since no error exists in the first transmission signal g131, the second transmission $data_{n+1}$ is not written into the shift register 71, and the shift register 71 is kept in the state in which the first transmission $data_{n+1}$ is written therein.

At the time t97, since an error exists in the second transmission $data_{n+1}$, and the last discriminant signal is in the H level as a result of the discrimination on whether or not an error exists based on the CRC on the second transmission $data_{n+1}$ included in the second transmission signal g132, the discriminant section 6 keeps the discriminant signal in the H level.

In the period from the time t98 to the time t99, the receiving section 2 receives the third transmission signal g133 including the third transmission $data_{n+1}$ output by the controller 9.

At the time t99, since no error exists in the first transmission signal g131, the third transmission $data_{n+1}$ is not written into the shift register 71, and the shift register 71 is kept in the state in which the first transmission $data_{n+1}$ is written therein. In the present embodiment, as described above, in the case of receiving a plurality of transmission signals (data signals) between the instruction signals, the shift register 71 holds the first transmission $data_{n+1}$ included in the first transmission signal g131, which is one received at the earliest time of the error free transmission signals received between the instruction signals. The shift register 71 performs the shift operation of the print data if the discriminant signal is in the L level, or neglects the subsequent print data and does not perform the shift operation of the print data if the discriminant signal is in the H level.

At the time t100, the discriminant section 6 discriminates that no error exists in the third transmission $data_{n+1}$ as a result of the discrimination on whether or not an error exists based on the CRC on the third transmission $data_{n+1}$ included in the third transmission signal g133. In this case, since no error exists in the first transmission signal g131, and the last discriminant signal is in the H level, the discriminant section 6 keeps the discriminant signal in the H level.

It should be noted that the discriminant section 6 can also be arranged not to discriminate whether or not an error exists in the print data on the second transmission signal g132 and the third transmission signal g133 since no error exists in the first transmission signal g131.

After predetermined time elapses from when outputting the third transmission signal g123, namely at the time t101, the controller 9 changes the instruction signal from the L level to the H level. In the period from the time t101 to the time t102, the controller 9 keeps the instruction signal in the H level.

At the time t101, since the discriminant signal is in the H level, and therefore, the output of the AND circuit 3 is in the H level, the latch circuits 72 perform the latch operation on the first transmission $data_{n+1}$ having already been written in the shift register 71 to rewrite the second transmission $data_{n-1}$ with the first transmission $data_{n+1}$.

At the time t102, the controller 9 restores the instruction signal from the H level to the L level.

The discriminant section 6 restores the discriminant signal from the H level to the L level after predetermined time elapses from when the instruction signal has changed from the H level to the L level, namely at the time t103.

After predetermined time elapses from when the instruction signal has changed from the H level to the L level, namely in the period from the time t104 to the time t105, the control section 7 performs generation of the waveform signal (ejection waveform) based on the first transmission $data_{n+1}$ of the print data g331 held by the latch circuits 72, and then performs printing based on the waveform signal thus generated. It should be noted that it is also possible to arrange that the control section 7 performs printing when, or after the falling edge of the discriminant signal has been detected within a predetermined period from the falling edge of the instruction signal.

As described above, in the present embodiment, it is arranged that the controller 9 transmits a plurality of transmission signals between the instruction signals. The liquid jet device 1 is arranged to perform printing using one received at the earliest time of the error free print data received if one or more error free print data exist in the plurality of the print data received between the instruction signals. Further, in the present embodiment, in the case in which an error exists in all of the plurality of the print data received between the instruction signals, it is arranged that the printing is performed using the error free print data held by the latch circuit 72.

Thus, according to the present embodiment, since it is arranged that the plurality of redundant transmission signals is transmitted between the instruction signals from the controller 9 to the liquid jet device 1, the signal line for outputting an acknowledge signal and the signal line for instructing the retry operation used in the related art technology become unnecessary for the connection between the controller and the liquid jet device. It should be noted that since these signals are used for the error processing, it is necessary to output these signals from the liquid jet device to the controller at high speed.

Further, although in FIG. 8 through FIG. 11, there is described the example of using three transmission signals as the plurality of redundant transmission signals transmitted between the instruction signals, the number of the transmission signals can be one as in the first embodiment, or two, or four or more.

It should be noted that although in the example described above, the description is presented using the example of the configuration of the liquid jet device 1, the liquid jet device can also be provided with the error counting section 62 (see FIG. 7) as in the liquid jet device 1A. In this case, it is also possible for the controller 9A (see FIG. 7) to be arranged to read out the number of errors stored in the error counting section 62, and change the number of transmission signals transmitted between the instruction signals in accordance with the number of errors. It is also possible for the controller 9A to be arranged to set the number of the transmission signals transmitted between the instruction signals to, for example, one if the number of errors is smaller than a first threshold value, two in the case in which the number of errors is no smaller than the first threshold value and smaller than a second threshold value, three in the case in which the number of error is no smaller than the second threshold value and smaller than a third threshold value, or abort printing in the case in which the number of errors is no smaller than the third threshold value.

Third Embodiment

In the first embodiment and the second embodiment, there is described the example having the single control section 7. However, it is also possible to adopt the two or more control sections 7 cascaded to each other.

Figure 12:
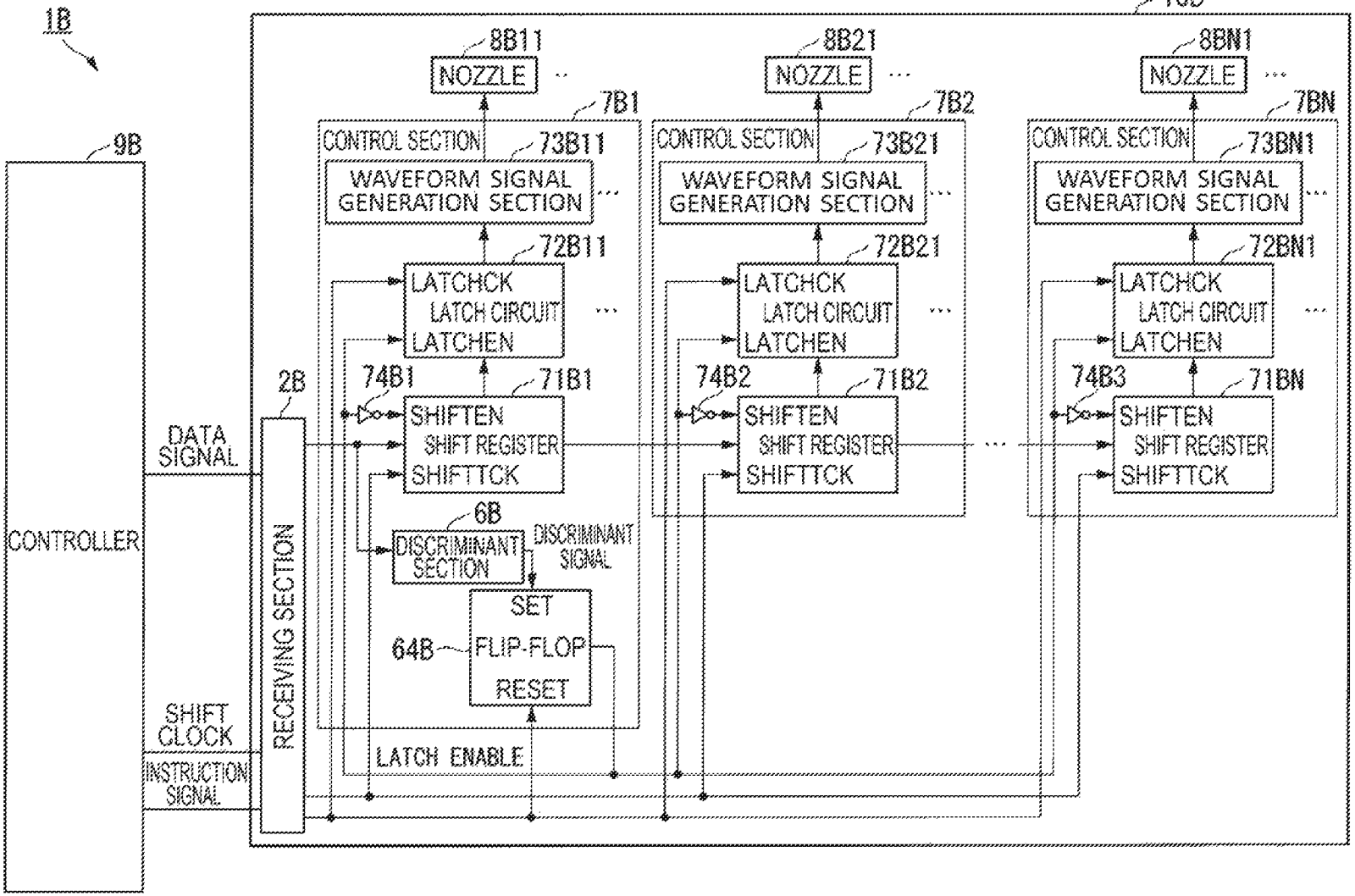
FIG. 12 is a diagram showing a schematic configuration example of a liquid jet device having control sections cascaded to each other according to a third embodiment.

FIG. 12 is a diagram showing a schematic configuration example of a liquid jet device 1B having control sections 7B cascaded to each other according to the present embodiment. It should be noted that in FIG. 12, there is shown an example in which the eight nozzles are connected to each of the control sections, but the number of the nozzles is not limited to this example.

As shown in FIG. 12, the liquid jet device 1B is provided with liquid jet heads 10B and a controller 9B.

The liquid jet heads 10B are each provided with a receiving section 2B, a control section 7B1, . . . , and a control section 7BN (N is an integer no smaller than 2), and nozzles 8B1, . . . , and nozzles 8BN. It should be noted that the control section 7B1, . . . , and the control section 7BN are referred to as the control sections 7B unless one of the control section 7B1, . . . , and the control section 7BN is identified. Further, the nozzles 8B1, . . . , and the nozzles 8BN are referred to as the nozzles 8B unless one of the nozzles 8B1, . . . , and the nozzles 8BN is identified.

The control section 7B1 is provided with a flip-flop (FF) 64B, a discriminant section 6B, a NOT circuit 74B1, a shift register 71B1, latch circuits 72B11 through 72B18, and waveform signal generation sections 73B11 through 73B18. The latch circuits 72B11 through 72B18 are referred to as latch circuits 72B1 unless one of the latch circuits 72B11 through 72B18 is identified. Further, the waveform signal generation sections 73B11 through 73B18 are referred to as waveform signal generation sections 73B1 unless one of the waveform signal generation sections 73B11 through 73B18 is identified.

The nozzles 8B1 correspond to the nozzles 8B11 through 8B18.

The control section 7B2 is provided with a NOT circuit 74B2, a shift register 71B2, latch circuits 72B21 through 72B28, and waveform signal generation sections 73B21 through 73B28. The latch circuits 72B21 through 72B28 are referred to as latch circuits 72B2 unless one of the latch circuits 72B21 through 72B28 is identified. Further, the waveform signal generation sections 73B21 through 73B28 are referred to as waveform signal generation sections 73B2 unless one of the waveform signal generation sections 73B21 through 73B28 is identified.

The nozzles 8B2 correspond to the nozzles 8B21 through 8B28.

The control section 7BN is provided with a NOT circuit 74BN, a shift register 71BN, latch circuits 72BN1 through 72BN8, and waveform signal generation sections 73BN1 through 73BN8. The latch circuits 72BN1 through 72BN8 are referred to as latch circuits 72BN unless one of the latch circuits 72BN1 through 72BN8 is identified. Further, the waveform signal generation sections 73BN1 through 73BN8 are referred to as waveform signal generation sections 73BN unless one of the waveform signal generation sections 73BN1 through 73BN8 is identified.

The nozzles 8BN correspond to the nozzles 8BN1 through 8BN8.

The latch circuits 72B1, . . . , and the latch circuits 72BN are referred to as latch circuits 72B unless one of the latch circuits 72B1, . . . , and the latch circuits 72BN is identified. The waveform signal generation sections 73B1, . . . , and the waveform signal generation sections 73BN are referred to as the waveform signal generation sections 73B unless one of the waveform signal generation sections 73B1, . . . , and the waveform signal generation sections 73BN is identified. The NOT circuit 74B1, . . . , and the NOT circuit 74BN are referred to as the NOT circuit 74B unless one of the NOT circuit 74B1, . . . , and the NOT circuit 74BN is identified.

It should be noted that it is possible to provide a drive circuit between the waveform signal generation section and the nozzle.

The data signal (the transmission signal) includes the print data and, for example, the CRC.

The discriminant section 6B discriminates whether or not an error exists in the print data included in the data signal based on, for example, the CRC. The discriminant section 6B outputs the discriminant signal representing the result of the discrimination to the flip-flop 64B.

The flip-flop 64B is a D-type flip-flop. To a SET input end of the flip-flop 64B, there is input the discriminant signal output by the discriminant section 6B, and to a RESET input end thereof, there is input the instruction signal. The flip-flop 64B holds the state (the L level or the H level) of the discriminant signal at the timing at which the instruction signal rises, and then outputs the signal thus held to the latch circuits 72B and the NOT circuits 74B of the control sections 7B as the LATCH ENABLE signal.

In each of the latch circuits 72B, the data signal is input to a data input end, the instruction signal is input to a LATCHCK input end, and the LATCH ENABLE signal output by the flip-flop 64B is input to a LATCHEN input end.

In each of the shift registers 71B, the LATCH ENABLE signal having been inverted by the NOT circuit 74B is input to a SHIFTEN input end, and a shift clock signal is input to a SHIFTCK input end.

Therefore, in the present embodiment, it is arranged that whether or not an error exists in the print data is discriminated by the control section 7B1 in the first stage of the control sections 7B1, . . . , and the control section 7BN cascaded to each other, and then the LATCH ENABLE signal as the signal based on the discriminant signal is output to the other control sections 7B. Thus, it is possible for the control sections 7B other than the control section 7B1 in the first stage can control the latch operation in accordance with the LATCH ENABLE signal generated by the control section 7B1 in the first stage. Thus, the constituents of the liquid jet device 1B can be reduced.

It should be noted that although in the example shown in FIG. 12, there is shown the example in which the flip-flop 64B and the discriminant section 6B are provided to the control section 7B1 in the first stage, but it is also possible to externally attach the flip-flop 64B and the discriminant section 6B to the control section 7B1 in the first stage.

It should be noted that the liquid jet devices (1, 1A, 1B) described in the first through third embodiments can also be of other types such as a thermal (Bubble Jet (registered trademark)) type.

It should be noted that it is also possible to store a program for realizing a part or the whole of the function of the liquid jet device 1 (or 1A, 1B) according to the invention in a computer-readable recording medium, and then make a computer system retrieve and then execute the program stored in the recording medium to thereby perform a part or the whole of the process to be performed by the liquid jet device 1 (or 1A, 1B). It should be noted that the "computer system" mentioned here should include an OS and the hardware such as peripheral devices. Further, the "computer system" should also include a WWW system provided with a home page providing environment (or a display environment). Further, the "computer-readable recording medium" denotes a portable recording medium such as a flexible disk, a magneto-optical disk, a ROM, a CD-ROM, or a flash memory, or a storage device such as a hard disk incorporated in the computer system. Further, the "computer-readable recording medium" should include those holding a program for a certain period of time such as a volatile memory (a RAM) in a computer system to be a server or a client in the case of transmitting the program via a network such as the Internet, or a communication line such as a telephone line.

Further, the program described above can be transmitted from the computer system having the program stored in the storage device or the like to another computer system via a transmission medium or with a transmission wave in the transmission medium. Here, the "transmission medium" for transmitting the program denotes a medium having a function of transmitting information such as a network (a communication network) such as the Internet or a communication line (a communication wire) such as a telephone line. Further, the program described above can be for realizing a part of the function described above. Further, the program described above can be a program, which can realize the function described above in combination with a program having already been recorded on the computer system, namely a so-called differential file (a differential program).

The configurations for implementing the invention are hereinabove described using the embodiments, but the invention is not at all limited to such embodiments, and is subject to a variety of modifications and replacements within the scope and spirit of the invention.

What is claimed is:

1. A liquid jet head comprising:

a receiving section adapted to receive a plurality of print data including a first print data and second print data, wherein the first print data is received prior to the second print data;

a discriminant section adapted to discriminate whether or not the second print data received is non-defective; and a control section adapted to hold the second print data in a case in which the second print data is non-defective, and perform printing based on the first print data previously received and held currently without holding the second print data received in a case in which the second print data received is defective.

2. The liquid jet head according to claim 1, wherein the discriminant section performs an error check on each of the plurality of print data transmitted between instruction signals adapted to instruct output, and the control section holds non-defective ones of the plurality print data, including the first print data, in a case in which any one of the plurality of print data is non-defective, and does not hold any of the plurality of print data, including the second print data, in a case in which all of the print data are defective.

3. The liquid jet head according to claim 2, wherein in a case in which the control section has received the plurality of print data, the control section holds the first print data, the first print data having been received at an earliest time of receiving the plurality of print data that is non-defective.

4. The liquid jet head according to claim 1, wherein an error detection code is attached to the second print data.

5. The liquid jet head according to claim 1, wherein the discriminant section counts a number of times of occurrence of a state in which individual ones of the plurality of print data is defective so as to store the number to a storage section.

6. The liquid jet head according to claim 1, wherein the control section in a first stage of the plurality of control sections is provided with the discriminant section, and the discriminant section provided to the control section in the first stage performs the discrimination on whether or not the second print data is non-defective, so as to output a result of the discrimination to the other control sections.

7. A liquid jet device comprising:

liquid jet head according to claim 1; and a controller adapted to transmit the plurality of print data to the liquid jet head.

* * * * *